US007603799B2

(12) United States Patent
Campomanes

(10) Patent No.: US 7,603,799 B2
(45) Date of Patent: Oct. 20, 2009

(54) CAMMED CONNECTOR PIN ASSEMBLY AND ASSOCIATED EXCAVATION APPARATUS

(75) Inventor: Patrick S. Campomanes, Coppell, TX (US)

(73) Assignee: Hensley Industries, Inc., Dallas, TX (US)

( * ) Notice: Subject to any disclaimer, the term of this patent is extended or adjusted under 35 U.S.C. 154(b) by 615 days.

(21) Appl. No.: 11/432,682

(22) Filed: May 11, 2006

(65) Prior Publication Data

US 2007/0261278 A1 Nov. 15, 2007

(51) Int. Cl.
*E02F 9/28* (2006.01)

(52) U.S. Cl. ..... 37/456; 37/459; 403/22

(58) Field of Classification Search ..... 37/455, 37/456, 452, 453; 172/713; 403/220, 424, 403/317

See application file for complete search history.

(56) References Cited

U.S. PATENT DOCUMENTS

| | | | | | |
|---|---|---|---|---|---|
| 943,775 | A | * | 12/1909 | Exton et al. | 37/454 |
| 1,548,374 | A | * | 8/1925 | Mullally | 37/455 |
| 1,690,834 | A | * | 11/1928 | Ratkowski | 37/455 |
| 1,917,431 | A | * | 7/1933 | Clark | 37/455 |
| 2,635,366 | A | * | 4/1953 | Hostetter | 37/459 |
| 2,805,496 | A | * | 9/1957 | Jordan | 37/456 |
| 3,831,298 | A | * | 8/1974 | Helton et al. | 37/457 |
| 4,067,657 | A | * | 1/1978 | Kaarlela | 403/317 |
| 5,077,918 | A | * | 1/1992 | Garman | 37/452 |
| 5,336,225 | A | * | 8/1994 | Zang | 606/304 |
| 5,435,084 | A | * | 7/1995 | Immel | 37/398 |
| 5,564,206 | A | | 10/1996 | Ruvang | |
| 5,718,070 | A | | 2/1998 | Ruvang | |
| 5,833,323 | A | * | 11/1998 | Massa et al. | 299/102 |
| 5,909,962 | A | * | 6/1999 | Livesay et al. | 37/456 |
| 5,913,605 | A | * | 6/1999 | Jusselin et al. | 37/451 |
| 5,926,982 | A | * | 7/1999 | Keech et al. | 37/455 |
| 5,983,534 | A | | 11/1999 | Robinson et al. | |
| 5,992,063 | A | * | 11/1999 | Mack | 37/450 |
| 6,030,143 | A | | 2/2000 | Kreitzberg | |
| 6,032,390 | A | | 3/2000 | Bierwith | |
| 6,053,655 | A | * | 4/2000 | Mazhar | 403/320 |
| 6,108,950 | A | | 8/2000 | Ruvang et al. | |
| 6,301,810 | B1 | * | 10/2001 | Fidler | 37/458 |
| 6,439,796 | B1 | | 8/2002 | Ruvang et al. | |
| 6,708,431 | B2 | | 3/2004 | Robinson et al. | |
| 6,848,203 | B2 | * | 2/2005 | Hohmann et al. | 37/446 |
| 6,976,325 | B2 | | 12/2005 | Robinson et al. | |

(Continued)

FOREIGN PATENT DOCUMENTS

AU 2003264586 A1 7/2004

*Primary Examiner*—Thomas A Beach
(74) *Attorney, Agent, or Firm*—Haynes and Boone, LLP

(57) ABSTRACT

A hammerless connector pin assembly is insertable in the aligned connector openings in telescoped excavation wear and support members and has associated locking structure for releasably locking the inserted assembly therein. The inserted assembly has opposite end portions that block removal of the wear member from the support member. One of such end portions has a laterally projecting cam member disposed thereon which is positioned within one of the wear member openings. As the interior surface of the wear member becomes worn from use and is able to shift further rearwardly along the support member, the cam member may be rotationally adjusted to maintain contact with the wear member to prevent forward movement thereof away from its rearward shifted position.

18 Claims, 7 Drawing Sheets

U.S. PATENT DOCUMENTS

| | | | | |
|---|---|---|---|---|
| 6,986,216 | B2 * | 1/2006 | Emrich et al. | 37/450 |
| 7,032,334 | B2 * | 4/2006 | Pippins | 37/455 |
| 7,178,274 | B2 * | 2/2007 | Emrich | 37/453 |
| 7,313,877 | B2 * | 1/2008 | Clendenning et al. | 37/456 |
| 2003/0070330 | A1 * | 4/2003 | Olds et al. | 37/456 |
| 2004/0016153 | A1 * | 1/2004 | Pippins | 37/456 |
| 2004/0237354 | A1 | 12/2004 | Emrich | |

* cited by examiner

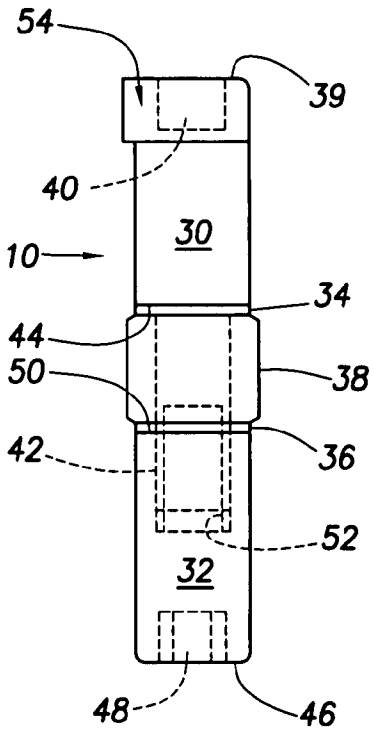
FIG.4
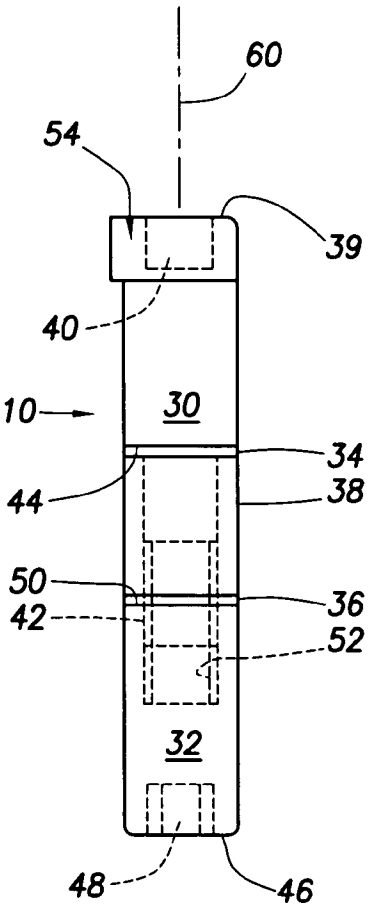
FIG.3
FIG.2
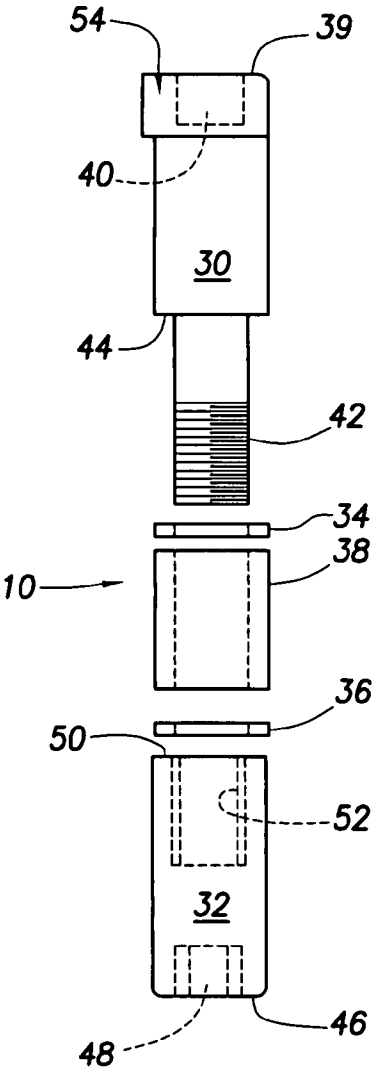

CAMMED CONNECTOR PIN ASSEMBLY AND ASSOCIATED EXCAVATION APPARATUS

BACKGROUND OF THE INVENTION

The present invention generally relates to material displacement apparatus and, in a preferred embodiment thereof, more particularly relates to apparatus for releasably coupling a replaceable excavating tooth point or other wear member to an associated adapter nose structure.

A variety of types of material displacement apparatus are provided with replaceable wear portions that are removably carried by larger base structures and come into abrasive, wearing contact with the material being displaced. For example, excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, generally aligned transverse openings are formed through these interchangeable elements adjacent the rear end of the point, and a suitable connector structure is driven into and forcibly retained within the aligned openings to releasably anchor the replaceable tooth point on its associated adapter nose portion. A connector structure may also be driven into the aligned openings of other types of telescoped wear and support members such as, for example, an intermediate adapter mounted on the nose of a base adapter.

The connector structure typically has to be forcibly driven into the aligned wear member and support member nose openings using, for example, a sledge hammer. Subsequently, the inserted connector structure has to be forcibly pounded out of the wear member and support member openings to permit the worn wear member to be removed from the support member and replaced. This conventional need to pound in and later pound out the connector structure can easily give rise to a safety hazard for the installing and removing personnel.

This problem is substantially alleviated by the hammerless connector structure illustrated and described in U.S. Pat. No. 6,439,796 to Ruvang et al, assigned to the assignee of the present invention, the disclosure of such patent being hereby incorporated herein by reference. Basically, this hammerless connector structure comprises two longitudinal threaded connector pin sections which are longitudinally inserted toward each other through the wear member and support member connector openings and then threaded together within the interior of the support member opening. Illustratively, the two threaded-together connector pin sections are held in place within the wear member and support member openings by a resilient member compressed between the two connector pin sections or by an internal support member ledge portion interposed between annular ledge portions of the threaded-together connector pin sections. When desired, the inserted connector pin structure may be removed by simply unscrewing the two pin sections from one another and removing them from the wear member and support member openings.

While this design eliminates the need to pound in and then pound out the connector pin structure, it is not operative to compensate for operational surface interface wear between the nose portion of the support member and the wear member which is telescoped onto the nose. Such surface interface wear permits the wear member to move back and forth on the support member nose toward and away from the original installed orientation of the wear member. This, in turn, undesirably accelerates the surface interface wear between the wear member and the support member within the wear member socket area.

In view of the foregoing it can readily be seen that a need exists for a hammerless connector pin structure that is provided with the capability of adjusting for the "loosening" wear between an excavating support member and a wear member telescoped onto the support member. It is to this need that the present invention is primarily directed.

SUMMARY OF THE INVENTION

In carrying out principles of the present invention, in accordance with representatively illustrated embodiments thereof, a specially designed connector pin assembly is provided for captively and releasably retaining a replaceable excavating wear member on a support member. Illustratively, the wear and support members may respectively be a tooth point and an adapter, or an intermediate adapter and a base adapter.

The wear member is representatively of a hollow, tapered configuration and is rearwardly telescoped onto a tapered nose portion of the support member. When it is initially installed over the support member nose portion, the wear member may move rearwardly along the nose portion to an initial rear limit or "tightened" orientation. However, after the overall wear member/support member structure is used for a time the tremendous forces excavating forces that it is subjected to cause significant surface wear at the interior interface between the wear and support members. This undesirably "loosens" the wear member and permits it to shift rearwardly along the support member to a rearwardly shifted tightened orientation. During excavation operations this, in turn, permits the wear member to forwardly and rearwardly "rattle" on the support member in a manner undesirably accelerating abrasion wear at the support member/wear member surface interface.

With the wear member operatively telescoped onto the support member nose, first and second connector openings in opposite side wall portions of the wear member are generally aligned with a connector opening extending through the nose. The connector pin assembly is preferably of a "hammerless" construction which permits it to be placed in and removed from the aligned connector openings without pounding on the assembly with a sledge hammer or other driving implement. When the connector assembly is installed in these openings, opposite end portions of the assembly extend into the wear member connector openings and serve to block forward removal of the wear member from the support member.

According to a key aspect of the invention, the connector pin assembly is provided with tightening structure which is adjustable to rearwardly engage the wear member in both initial and rearwardly shifted tightened positions and prevent the wear member from shifting forwardly away from such positions along the support member nose. The tightening structure is representatively carried on a connector pin portion of the assembly and is movable between first and second positions to respectively engage the wear member in its initial and rearwardly shifted tightened positions to prevent forward shifting of the installed wear member from such tightened positions. The connector pin assembly is also provided with locking structure for releasably locking the wear member tightening structure in each of its first and second positions.

Preferably, the tightening structure is a cam member secured to an end of the connector pin portion of the assembly and disposed within one of the connector openings of the wear member. The cam member is rotatable between the aforementioned first and second tightening member positions, and has an eccentric, convoluted engagement surface that faces the interior surface of the wear member connector opening. Representatively, the locking structure is operative to selectively permit and preclude rotation of the connector pin structure relative to the support member to permit the cam to be selectively rotated to and releasably locked in its illustrative first and second positions. Of course, the eccentrically curved cam may engage and forwardly block the wear member in a multiplicity of rearwardly shifted positions of the wear member on the support member, and is thus not limited to two wear member blocking positions.

The connector pin portion of the assembly is illustratively formed from two coaxial, threadingly interconnected connector pin body portions having axially facing surfaces that may be threadingly moved toward and away from one another. The locking structure may include a resilient structure interposed between these facing surfaces and being compressible therebetween within the support member nose opening to lock the connector pin structure within the support member in a manner also preventing movement of the tightening member relative to the wear member.

In other illustrative embodiments of the connector pin assembly, the locking structure may include a tubular cartridge which is insertable into the support member connector opening and which coaxially receives the connector pin portion of the assembly. In these embodiments, the locking structure includes cooperating structures on the connector pin portion and the support member, and cooperating structures on the tubular cartridge and the support member. The cooperating structures on the tubular cartridge and the connector pin structure may be lateral projections on the cartridge, and an interior side surface recess of the support member connector opening in which the lateral cartridge projections are received. The cooperating structures on the connector pin structure and the cartridge may be cooperating splines and grooves thereon, resilient structures disposed within the cartridge and compressed between facing portions of the connector pin body portions and corresponding interior surface portions within the cartridge, or complementarily engageable tapered annular frictional locking abutment surfaces formed on a portion of the connector pin structure and an interior portion of the tubular cartridge.

The wear member structure may be rotationally adjusted, and subsequently locked in its adjusted orientation by simply loosening the threadingly interconnected connector pin body portions, rotationally adjusting the body portion on which the tightening member is disposed, and then retightening the pin body portions. In one embodiment of the connector pin assembly, circumferentially spaced stop surfaces are provided on the pin body portion carrying the tightening member to establish rotational limits for the tightening member.

BRIEF DESCRIPTION OF THE DRAWINGS

FIG. 2 is an exploded side elevational view of the cammed connector pin assembly removed from the wear and support members;

FIG. 3 is an assembled side elevational view of the connector pin assembly with a longitudinally intermediate resilient portion being in a relaxed state;

FIG. 4 is an assembled side elevational view of the cammed connector pin assembly with the annular resilient portion being axially compressed and radially expanded;

DETAILED DESCRIPTION

Figure 1:
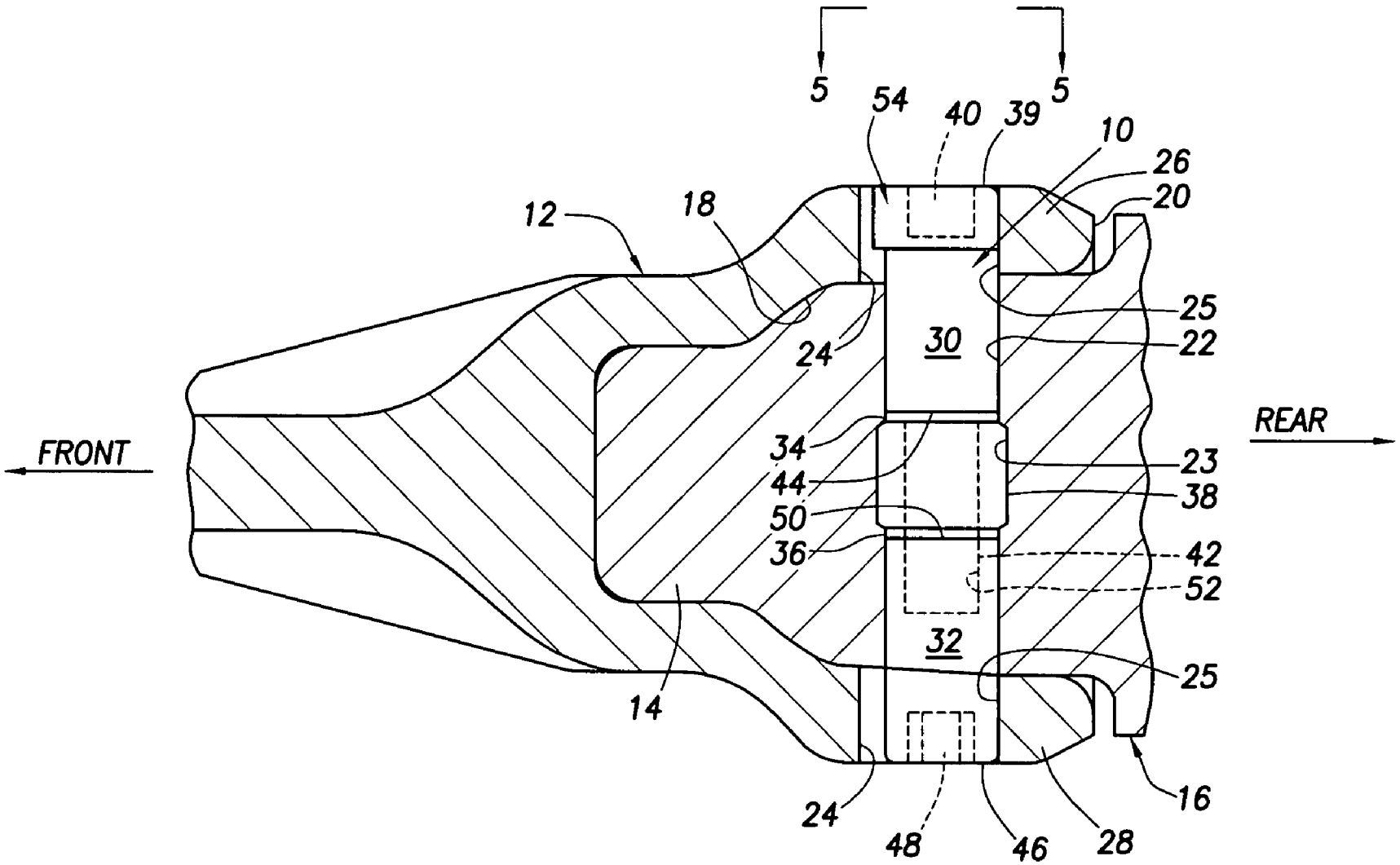
FIG. 1 is a partly elevational cross-sectional view of a nose portion of an excavating support member and a replaceable wear member releasably held on a nose portion of the support member by a specially designed cammed connector pin assembly embodying principles of the present invention.

As illustrated in FIGS. 1-4, in a representatively illustrated embodiment thereof this invention provides a specially designed connector pin assembly 10 that is used to releasably hold a wear member, representatively an excavating tooth point 12, on the nose 14 of an associated support member, representatively an adapter structure 16. It will be appreciated by those of skill in this particular art that other types of wear members, such as for example an intermediate adapter, could also be captively and releasably retained on the adapter nose 14 by the connector pin assembly 10 if desired.

In a conventional manner, the replaceable tooth point 12 has an internal socket 18 extending in a forward direction inwardly from its rear end 20, with the tapered adapter nose 14 being complementarily received in the socket 18. A transverse, circularly cross-sectioned opening 22 extends through the adapter nose 14 and is generally aligned with corresponding openings 24 formed in opposite side wall portions 26,28 of the tooth point 12. Each opening 24 has a rear surface portion 25 (see FIG. 1). In a manner subsequently described herein, the connector pin assembly 10 is inserted into the aligned openings 22,24 and is retained therein to thereby releasably retain the tooth point 12 in place on the adapter nose 14.

The connector pin assembly 10 provides substantial improvements with respect to cylindrical "snap-ring" connectors that have bodies which must be pounded (for example, with a sledge hammer) into the aligned adapter nose and tooth point openings 22,24 to compress a snap ring carried in an annular groove on the pin body and then permit the compressed snap ring to expand into an enlarged opening portion within the adapter nose 14 to thereby lock the inserted pin within the adapter nose and tooth openings 22,24. This previously utilized connector pin structure has several disadvantages—for example, the inherent hazards of having to pound the pin in and out of the adapter/tooth assembly, and the potential for operational impact loads imposed on the inserted pin structure to dislodge it from the tooth/adapter assembly.

The specially designed connector pin assembly 10, shown in exploded form in

FIG. 2, includes first and second cylindrical metal longitudinal body portions 30 and 32, upper and lower annular metal washers 34 and 36, and a tubular resilient member 38 which is representatively of an elastomeric material. The first cylindrical portion 30 has an outer end 39 with a square or hexagonal (or otherwise noncircular) recess 40 therein, and a reduced diameter, externally threaded inner end portion 42 projecting downwardly from an annular shoulder 44 on the first cylindrical portion 30.

The second cylindrical portion 32 has an outer end 46 with a square or hexagonal recess 48 formed therein, and an inner end 50 with an internally threaded, circularly cross-sectioned opening 52 extending thereinto. To assemble the connector pin assembly 10, as shown in FIG. 3, the externally threaded portion 42 of the first pin structure portion 30 is sequentially passed through the upper washer 34, the tubular elastomeric member 38 and the lower washer 36 and then threaded into the second connector pin portion opening 52 as shown in FIG. 3. In this initially assembled configuration of the connector pin assembly 10, the shoulder 44 abuts the washer 34, and the inner end 50 of the lower connector pin portion 32 abuts the washer 36, but the tubular elastomeric member 38 is in a relaxed state in which it is not substantially compressed in an axial direction.

The connector pin assembly 10 in its initially assembled, ready-to-install FIG. 3 orientation is then inserted (downwardly as viewed in FIGS. 1-4) into the aligned adapter nose and tooth point openings 22,24 until the tubular elastomeric member 38 is generally opposite a radially enlarged longitudinally intermediate portion 23 of the adapter nose opening 22. The threaded end 42 of pin portion 30 is then threaded further into the opening 52 of the other pin portion 32 (by rotating the pin portion 32 relative to the pin portion 30) to thereby force the facing pin surfaces 44,50 closer to one another. This, in turn, forces the washers 34,36 closer together to thereby axially compress and radially expand the tubular elastomeric member 38 as shown in FIGS. 1 and 4. With the connector pin assembly 10 inserted into the aligned adapter nose and tooth point openings 22,24 as shown in FIG. 1, this causes the radially expanded tubular elastomeric member 38 to enter the radially enlarged adapter nose opening portion 23 and lock the inserted connector pin assembly 10 in place against axial removal from the telescoped wear and support members 12,16. This, in turn, locks the wear member 12 on the support member nose portion 14 due to the illustrated outer ends of the body members 30,32 being disposed in the wear member connector openings 24 in a manner blocking forward removal of the point 12 from the adapter nose 14.

As can be seen in FIG. 1, the locking of the inserted connector pin assembly 10 within the generally aligned tooth point and adapter nose openings is achieved by a combination of (1) a frictional engagement between the radially expanded elastomeric member 38 and a side surface portion 23 of the adapter nose opening 22, and (2) a mechanical interlock between the radially expanded elastomeric member 38 and the enlarged adapter nose opening portion 23 that receives it. It will be readily appreciated by those of skill in this particular art, however, that the enlarged adapter nose opening portion 23 could be eliminated, if desired, so that the radially enlarged elastomeric member 38 could frictionally engage a side portion of the opening 22 without being mechanically interlocked with the adapter nose.

To remove the inserted connector pin assembly 10 from the adapter nose and tooth point openings 22,24 the lower pin portion 30 is rotationally backed away of the pin portion 30 to cause the tubular elastomeric member 38 to return to its FIG. 3 relaxed configuration and permit the connector pin assembly 10 to be simply pushed out of the aligned adapter nose and tooth point openings 22,24 in an upward direction as viewed in FIG. 1.

The construction of the connector pin assembly 10 permits it to be installed within the aligned adapter nose and tooth point openings without having to pound the connector pin assembly into such holes. Further, the expanded elastomeric member 38 within the radially enlarged adapter nose hole portion 23 acts as a "shock absorber" which desirably tends to hinder dislodgement of the inserted connector pin assembly 10 when axially directed operational loads are imposed thereon.

Figure 5:
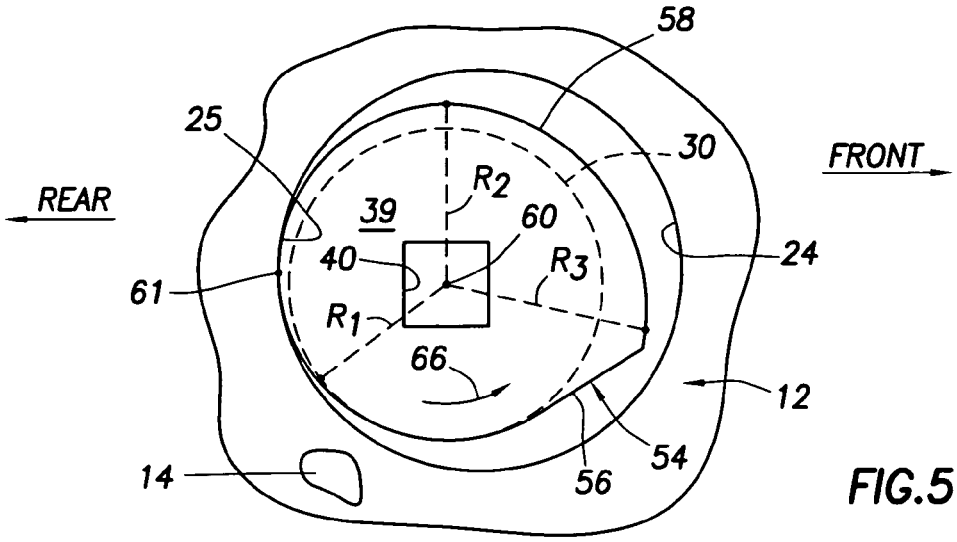
FIG. 5 is a side elevational view of a portion of the telescoped wear and support members, taken along line 5-5 of FIG. 1, illustrating the rotational orientation of a cammed end portion of the connector pin assembly, and the relative front-to-rear orientations of the wear member and support member nose, when the wear member is initially installed and rearwardly tightened on the support member nose.
Figure 5A:
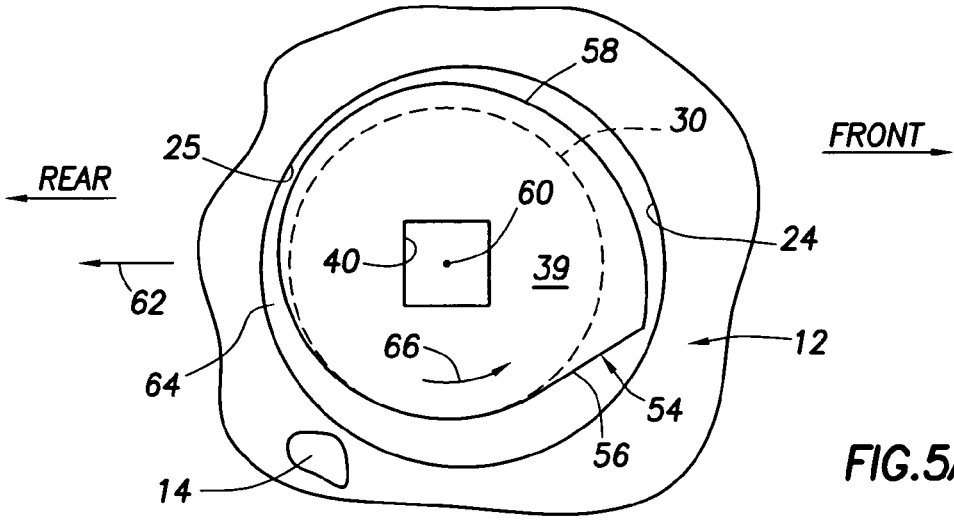
FIG. 5A is a view similar to that in FIG. 5, but illustrating a rearward shifting of the wear member relative to the support member nose permitted by operational surface interface wear between the nose and the wear member within the wear member pocket.
Figure 5B:
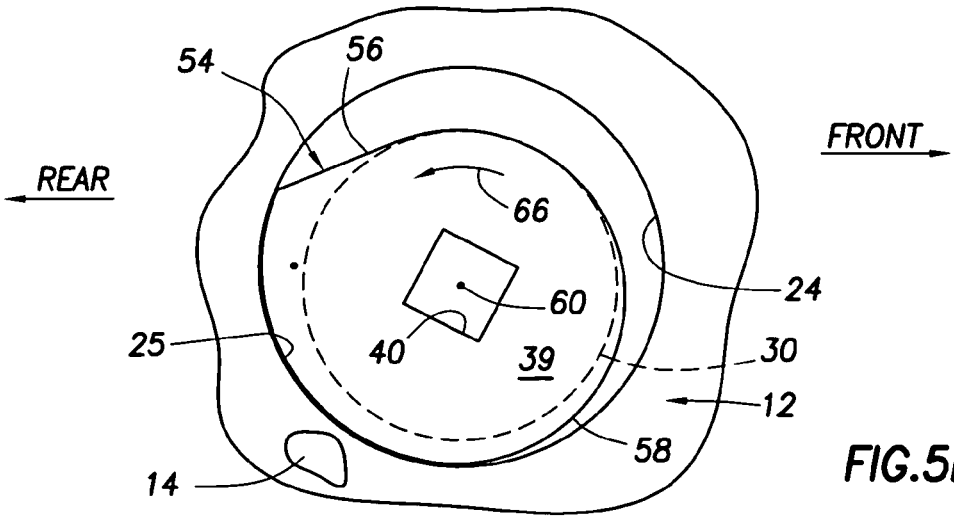
FIG. 5B is a view similar to that in FIG. 5A, but illustrating a simple rotational adjustment of the cammed connector pin end portion that causes it to rearwardly re-engage the rearwardly shifted wear member and prevent it from shifting forwardly along the support member nose, thereby "re-tightening" the wear member on the support member nose.

Referring now additionally to FIGS. 5-5B, according to a key feature of the present invention, the outer end 39 of the cylindrical pin body portion 30 has formed thereon a cam portion 54 that projects laterally outwardly from the periphery of the pin body portion 30. As subsequently described herein, the cam portion 54 functions as a wear member tightening structure. Cam 54, like its associated pin body portion 30 is representatively of a rigid metal construction, is preferably formed integrally with the body portion 30, and illustratively has an outer side surface with a flat portion 56 from the opposite ends of which an eccentrically curved, convoluted side surface portion 58 extends. As may best be seen in FIG. 5, the generally radial distances $R_1$, $R_2$ and $R_3$ from the longitudinal axis 60 of the pin body portion to the eccentrically curved cam side surface portion 58 progressively increase in a clockwise direction around the surface portion 58.

FIG. 5 representatively illustrates the wear member 12 as initially installed on the support member nose 14—i.e., before operational wear at the wear member/support member surface interface area within the wear member pocket 18 has occurred. With the wear member 12 shifted rearwardly on the nose 14 to its fully "tightened" position thereon, the assembled connector pin assembly 10 (see FIG. 3) is inserted into the wear and support member openings 24,22 as previously described, and appropriately rotated about the pin axis 60 until a portion of the curved cam surface 58 near point 61 thereon (see FIG. 5) rearwardly abuts the rear surface 25 of the wear member opening 24. As can be seen in FIG. 5, point 61 is on the left or "short" radius side of the cam surface 58 as viewed in FIG. 5.

With the cam 54 appropriately held in this rotational orientation, the pin body portion 32 is threadingly tightened on the stationary pin body portion 30 to bring the connector pin assembly 10 to its previously described operational configuration, shown in FIGS. 1 and 4, in which the assembly 10 is rotationally and axially locked relative to the telescoped wear and support members 12,16. The engagement between the rear portion of the cam surface 58 and the rear wear member opening 24 in the region of the cam surface point 61 shown in FIG. 5 utilizes the rotationally adjusted cam 58 as a forward abutment to prevent appreciable forward shifting of the wear member 12 relative to the nose 14.

Turning now to FIG. 5A, after a period of excavation use of the telescoped wear and support members 12,16 their interfacing surfaces within the wear member pocket 18 will begin to wear away in a manner "loosening" the fit of the wear member 12 on the nose 14. This permits the wear member 12 to rearwardly shift away from its FIG. 5 tightened position on the nose 14 and thereby shift rearwardly out of engagement with the cam surface 58, as indicated by the arrow 62, and create a gap 64 between the cam surface 58 and the rear side 25 of the wear member opening 24 in which the cam 54 is disposed. As can be seen, the presence of the gap 64 permits the wear member 12 to undesirably shift forwardly and rearwardly on the nose 14 (i.e., between its FIG. 5A position and a forwardly shifted position in which the wear member 12 again forwardly abuts the cam surface 58), thereby rattling on the nose 14 and aggravating the wear at the wear member/nose surface interface in the pocket 18.

The unique use of the cam 54, which serves as a tightening adjustment member, permits the now loosened wear member 12 to be retightened on the nose 14 in a simple manner. To effect this retightening, the pin body portion 32 (see FIGS. 1-4) is simply loosened sufficiently to permit the cam 54 to be rotated in a counterclockwise direction (in the direction of the tightening direction arrow 66 conveniently imprinted on the outer side 39 of the cam 54) until the cam surface 58 re-engages the rearwardly shifted rear surface portion 25 of the wear member opening 24 as shown in FIG. 5B. The pin body portion 32 is then re-tightened on the pin body portion 30 to lock the cam 54 in its rotationally adjusted position. As can be seen by comparing FIGS. 5A and 5B, this counterclockwise rotation of the cam 54 progressively closes the distance between its eccentrically curved surface 58 and the rearwardly shifted wear member opening surface portion 25 until the cam again contacts the surface portion 25 and forms a barrier to forward movement of the wear member 12 from its rearwardly shifted re-tightened FIG. 5B position.

As can be seen in FIGS. 1-4, the pin body surfaces 44 and 50, the washers 34 and 36, the resilient member 38 and the threaded interconnection between the pin body portions 30,32 function as representative locking structure for releasably locking the assembly 10 within the telescoped wear and support members with the tightening adjustment cam 54 in a selectively variable rotational orientation about the pin body axis 60 to permit the cam 54 to present a rearwardly adjustable abutment surface for a rear surface portion 25 of the wear member opening 24 in which the cam 54 is rotatably disposed.

Figure 6:
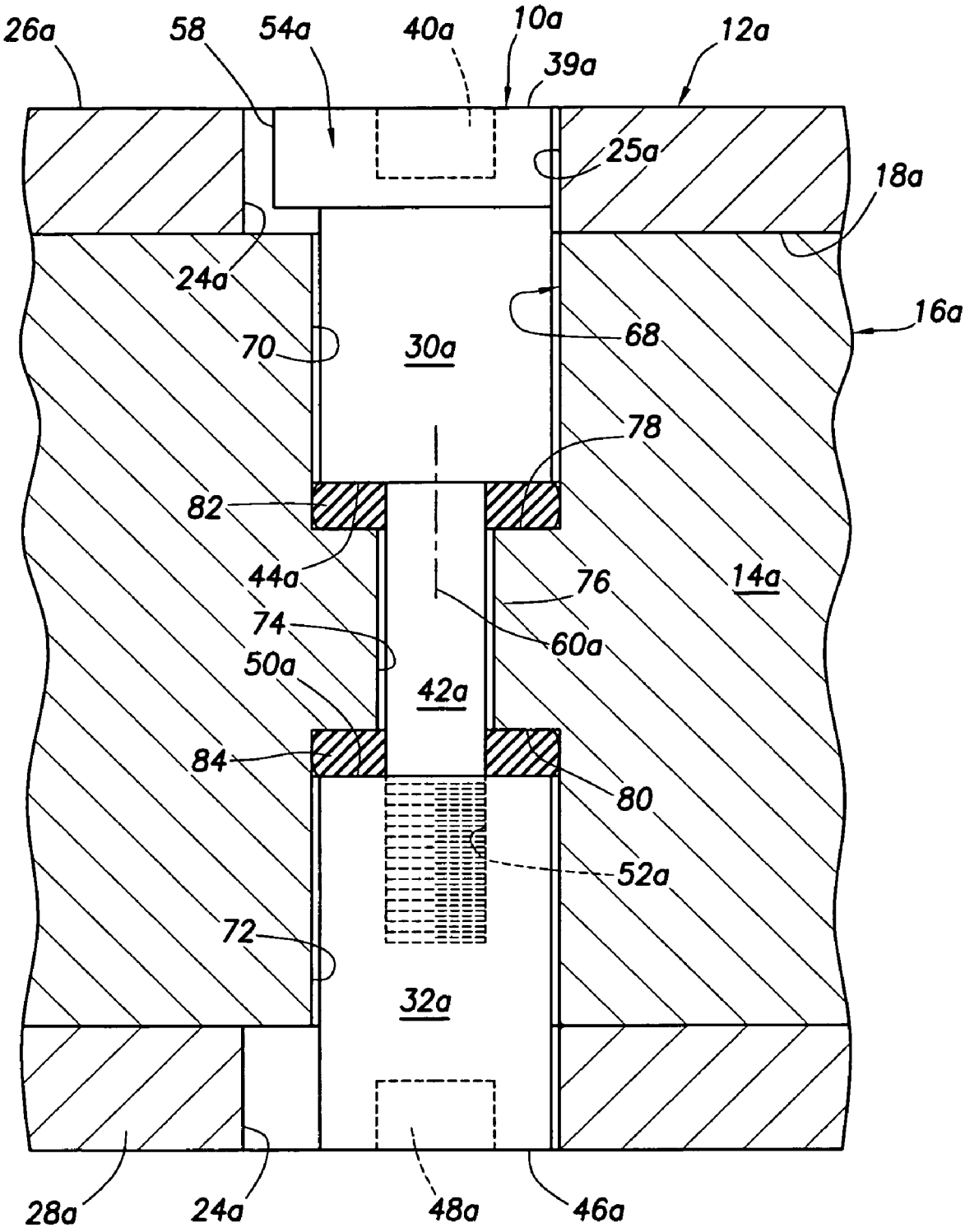
FIG. 6 is a partly elevational cross-sectional view of the replaceable wear member releasably held on a differently configured support member nose by a first alternate embodiment of the cammed connector pin assembly.

A first alternate embodiment 10*a* of the previously described connector pin assembly 10 is cross-sectionally shown in FIG. 6 being used to captively retain a wear member 12*a* on a support member nose 14*a*. For the purpose of facilitating a comparison of the FIG. 6 overall wear member/support member/connector pin assembly with its previously described FIG. 1 counterpart, components similar or identical to those in FIG. 1 have been given identical reference numerals with the subscripts "a".

The wear member 12*a* shown in FIG. 6 is illustratively identical to the previously described wear member 12 and has a pocket area 18*a* and opposite sidewalls 26*a*,28*a* with openings 24*a* formed therein, each opening 24*a* having a rearwardly disposed, forwardly facing surface area 25*a*. Representatively, but not by way of limitation, wear member 12 is a replaceable tooth point, and support member 16 is an adapter. Adapter nose 14*a* which is complementarily received in the tooth point pocket 18*a* has a circularly cross-sectioned opening 68 extending therethrough and generally aligned with the tooth point openings 24*a*. The adapter nose opening 68 is configured differently than the previously described adapter nose opening 22 (see FIG. 1), having upper and lower end segments 70 and 72 separated by a smaller diameter longitudinally intermediate segment 74. Reduced diameter opening segment 74 is defined by an annular section 76 of the adapter nose 14*a* that radially projects into the nose opening 68 and has upper and lower axially facing annular ledges 78,80.

The resilient intermediate portion of the connector pin assembly 10*a* is defined by upper and lower annular resilient members 82,84 which are representatively of an elastomeric material. Upper resilient member 82 circumscribes the reduced diameter threaded end portion 42*a* of the upper rigid pin body portion 30*a* received in the upper nose opening segment 70, and is interposed between the annular shoulder 44*a* of the rigid body portion 30*a* and the upper annular nose opening ledge 78. Lower resilient member 84 circumscribes the reduced diameter threaded end portion 42*a* of the upper rigid body portion 30*a*, and is interposed between the annular shoulder 50*a* of the rigid body portion 32*a* and the lower annular nose opening ledge 80.

With the adapter nose 14*a* received in the tooth point socket 18*a*, the connector pin assembly 10*a* may be easily installed, without having to pound its components into the point and adapter openings, by placing the annular resilient member 82 on the reduced diameter body portion 42*a*, inserting the upper rigid body portion 30*a* into the upper adapter nose opening segment 70 so that the reduced diameter body portion 42*a* extends downwardly through the middle nose opening segment 74 and into the lower nose opening segment 72, placing the lower annular elastomeric member 84 on the lower end of the body portion 42*a*, and threading the lower rigid body portion 32*a* onto the threaded body portion 42*a*.

Finally, using the square or hexagonal recesses 40*a*,48*a* and suitable upper and lower wrench members, the rigid body portions 30*a*,32*a* are threadingly advanced toward one another in a manner axially compressing and radially expanding the annular resilient members 82,84 respectively between facing annular surface pairs 44*a*,78 and 50*a*,80. In this manner, the resilient members 82,84 are compressed against interior surface portions of the adapter nose opening 68, thereby facilitating the retention of the connector pin assembly 10*a* within the generally aligned point and adapter openings 24*a*, 68 and providing the installed connector pin assembly 10*a* with axial resiliency against axial operational loads imposed thereon. As in the case of the previously described connector pin assembly 10, opposite outer end portions of the installed connector pin assembly 10*a* serve to block the removal of the tooth point 12*a* from the adapter nose 14*a* onto which it is telescoped.

Formed on the outer end of the pin body portion 30 is a cam 54*a* which is identical in structure and function to the previously described cam 54 incorporated in the connector pin assembly 10 shown in FIGS. 1-4. Cam 54*a* is shown in FIG. 6 in the rotational orientation to which it is adjusted when the tooth point 12*a* is initially installed on the adapter nose 14*a*. The rotational orientation of the cam 54*a* relative to the longitudinal axis of the connector pin assembly 10*a* may be selectively adjusted to cause the cam 54*a* to re-engage the point opening surface area 25*a* after the partially worn point 12*a* becomes able to rearwardly shift out of abutment with the cam 54*a* by simply threadingly loosening the pin body portion 32*a*, rotating the cam 54*a* (in the direction of its imprinted tightening arrow 66), and then re-tightening the pin body portion 32*a* to rotationally lock the re-oriented cam 54*a*.

It can be seen that the cam 54*a*, like the previously described cam 54, serves as a wear member-tightening adjustment member, while the threaded interconnection between the body members 30*a* and 32*b*, the resilient members 82 and 84, and the facing annular ledge pairs 44*a*,78 and 50*a*,80 function as representative locking structure for releasably locking the assembly 10*a* within the telescoped wear and support members with the tightening adjustment cam 54*a* in a selectively variable rotational orientation about the pin body axis 60*a* to permit the cam 54*a* to present a rearwardly adjustable abutment surface for a rear surface portion 25*a* of the wear member opening 24*a* in which the cam 54*a* is rotatably disposed.

A variety of modifications could be made to the connector pin assemblies 10 and 10*a* without departing from principles of the present invention. For example, while the resilient members 38 (FIG. 1) and 82,84 (FIG. 6) are preferably formed from an elastomeric material, they could be of alternate resilient constructions such as, for example, metal compression springs or bellows. Additionally, while the upper and lower rigid body portion pairs 30,32 and 30*a*,32*a* are threadingly movable axially toward and away from another by virtue of one body portion being directly screwed into the other one, such body portion pairs could alternatively be made to be threadingly interconnected and movable axially toward and away from one another using a third threaded element, such as a bolt extending axially through one of the rigid body portions and being threaded into the other one. Moreover, while the resilient members 38,82,84 are radially deflectable through a 360 degree arc, such radial deflection could extend through a lesser arc if desired.

Figure 7:
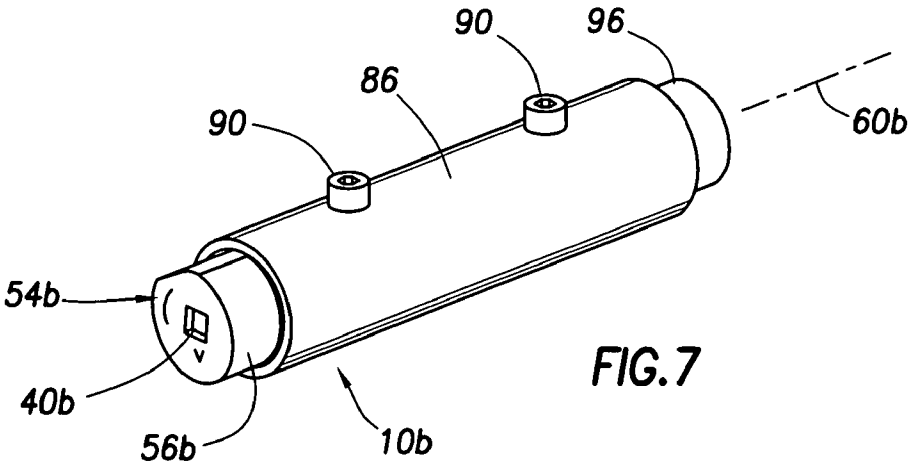
FIG. 7 is an assembled perspective view of a second alternate embodiment of the cammed connector pin assembly.
Figure 8:
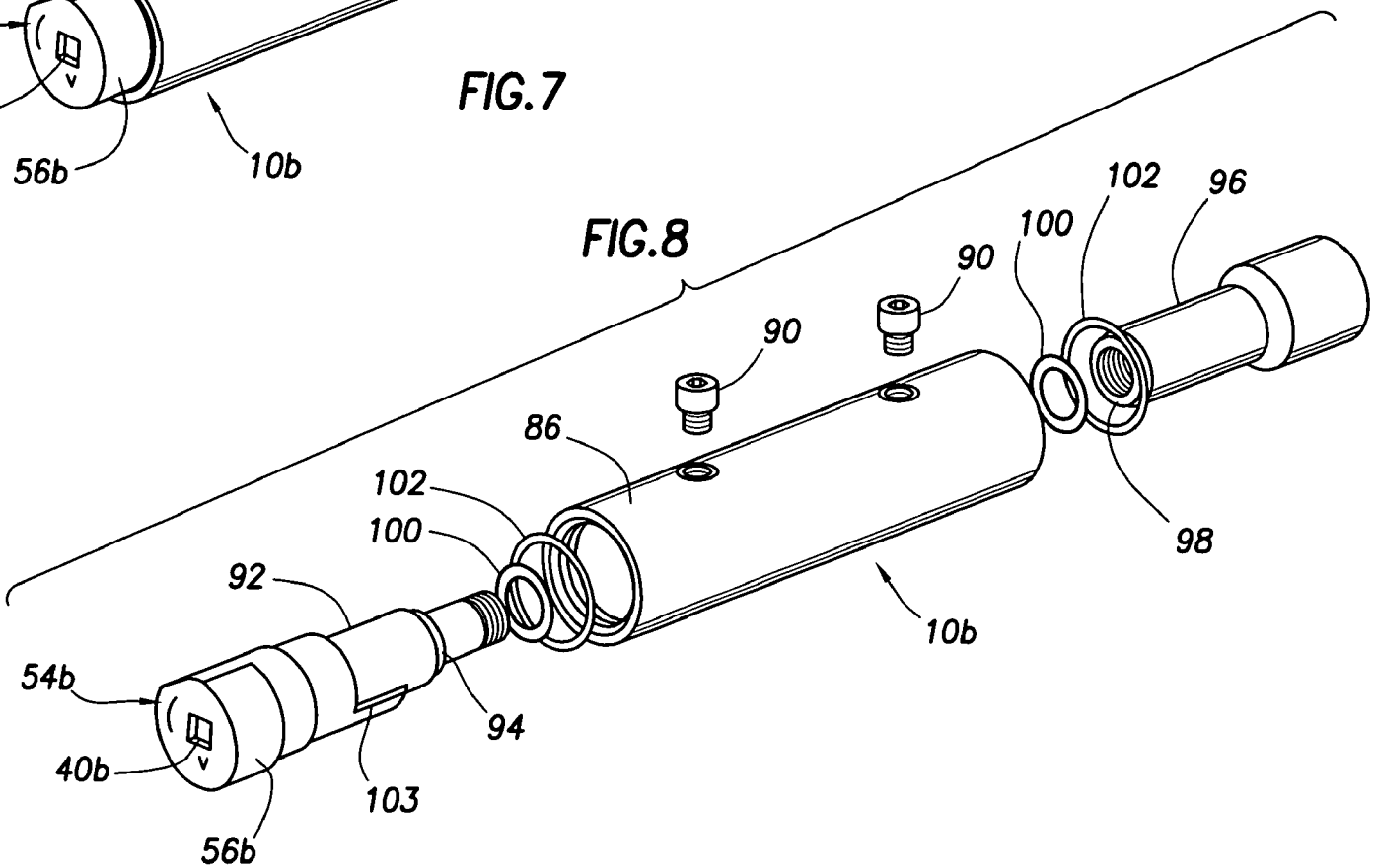
FIG. 8 is an exploded perspective view of the FIG. 7 cammed connector pin assembly.
Figure 9:
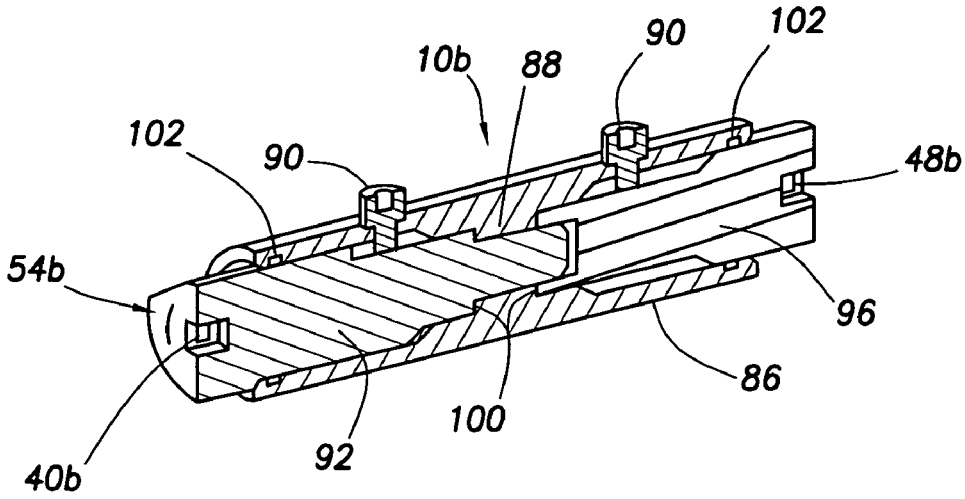
FIG. 9 is a laterally directed cross-sectional view through the FIG. 7 cammed connector pin assembly.
Figure 10:
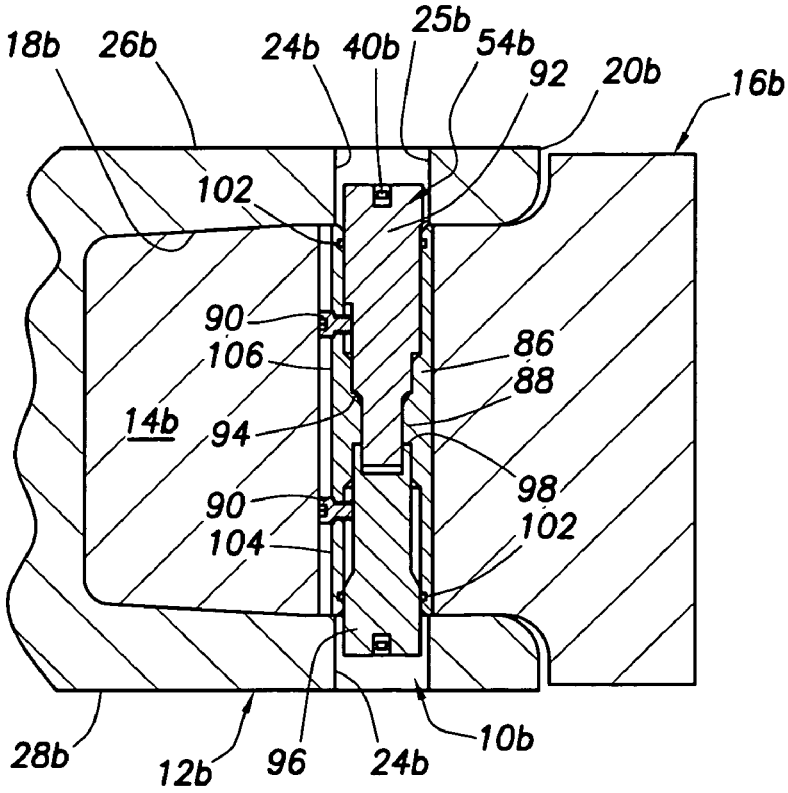
FIG. 10 is a cross-sectional view through portions of telescoped wear and support members being releasably interconnected by the FIG. 7 cammed connector pin assembly.

A second alternate embodiment 10*b* of the previously described connector pin assembly 10 is perspectively illustrated in FIGS. 7-9, and is cross-sectionally depicted in FIG. 10 being used to captively retain a wear member 12*b* on a support member nose 14*b*. For purposes of facilitating a comparison of the connector pin assembly 10*b* shown in FIGS. 7-9 with the connector pin assembly 10, and for comparing the. FIG. 10 overall wear member/support member/connector pin assembly with its previously described FIG. 1 counterpart, components in FIGS. 7-10 similar or identical to those in FIGS. 1-4 have been given identical reference numerals with the subscripts "b".

Representatively, but not by way of limitation, the wear member 12*b* is an intermediate adapter, and the support member 16*b* is a base adapter having a nose portion 14*b* onto which the intermediate adapter 12*b* is telescoped. Alternatively, of course, other types of wear and support members could be utilized if desired.

With reference now to FIGS. 7-10, the connector pin assembly 10*b* includes a hollow tubular cartridge 86 having a longitudinally intermediate interior boss 88, a longitudinally spaced pair of laterally outwardly projecting studs 90 threaded into the cartridge 16 and laterally extending into its interior, an elongated cylindrical male connector pin body member 92 with a longitudinally intermediate annular shoulder 94 (see FIGS. 8 and 10), and an elongated cylindrical female connector pin body member 96 with an annular inner end portion 98 (see FIGS. 8 and 10). Connector pin assembly 10 also includes a pair of annular lock washers 100 and a pair of annular elastomeric O-ring seal members 102. For later described purposes, a circumferentially spaced apart pair of axially extending stop surfaces 103 (one of which being visible in FIG. 8) are formed on a longitudinally intermediate portion of the connector pin body member 92.

To operatively and releasably mount the wear member 12*b* on the nose portion 14*b* of the support member 16*b*, the cartridge 86 is first longitudinally inserted into the nose opening 104 in a manner such that the cartridge studs 90 are received in a longitudinally extending side surface groove 106 formed in the nose opening 104. This receipt of the studs 90 into the groove 106 prevents the inserted cartridge 16 from rotating relative to the nose 14*b*.

Next, the wear member 12*b* is telescoped onto the nose 14*b*, and the connector pin body members 92,96 (with their associated lock washers 100 against their annular surfaces 94,98) are respectively inserted inwardly through the wear member connector openings 24*b* into the interior of the cartridge 86 and threaded together as shown in FIG. 10 to thereby compress the lock washers 100 between the connector member annular surfaces 94,98 and the axially oppositely facing annular surface portions of the interior cartridge boss 88. This prevents the threaded-together connector pin body members 92,96 from rotating relative to the cartridge 86. As can be seen in FIG. 10, with the connector members 22,26 threaded together in this manner, outer end portions of the threaded-together connector members 92,96 respectively project into the wear member connection openings 24*b* to thereby captively retain the wear member 12*b* on the nose portion 14*b* of the support member 16*b*. As illustrated, interior surface portions of the wear member walls 26*b*,28*b* near the connector openings 24*b* block axial removal of the cartridge 86 outwardly through the connector openings 24*b*.

The cam member 54*b* on the outer end of the connector pin body member 92 is identical in structure and operation as the previously described cam members 54,54*a* and (by temporarily loosening the threaded connection between the connector pin body portions 92,96) may be rotated to engage the rear surface portion 25*b* of its associated wear member opening 24*b* after the partly worn wear member 12*b* is able to rearwardly shift along the nose 14*b*, and then rotationally locked in place by re-tightening the connector pin body portions 92,96 to one another. The previously mentioned circumferentially spaced apart stop surfaces 103 (see FIG. 8) underlie the left stud 90 (as viewed in FIG. 9) and serve to engage the stud at predetermined clockwise and counterclockwise rotational limits of the cam 54*b*. For purposes of illustration, in FIG. 10 the cam 54*b* is shown after its has been rotated from its initially installed rotational orientation to operatively contact the wear member opening surface 25*b* after the wear member 12*b* has been partially worn to an extent that it can rearwardly shift out of engagement with the initially positioned cam 54*b*.

It can be seen that the cam 54*b*, like the previously described cams 54 and 54*a*, serves as a wear member-tightening adjustment member, while the cartridge 86, the threaded interconnection between the body members 92 and 96, the lock washers 100, the internal cartridge boss 88, the interengagement of the lugs 90 and the nose opening groove 106, and the opposite ends of the cartridge 86 (which are outwardly blocked by inner side surfaces of the wear member 12*b*) function as representative locking structure for releasably locking the assembly 10*b* within the telescoped wear and support members with the tightening adjustment cam 54*b* in a selectively variable rotational orientation about the pin body axis 60*b* to permit the cam 54*b* to present a rearwardly adjustable abutment surface for a rear surface portion 25*b* of the wear member opening 24*b* in which the cam 54*b* is rotatably disposed.

Figure 11:
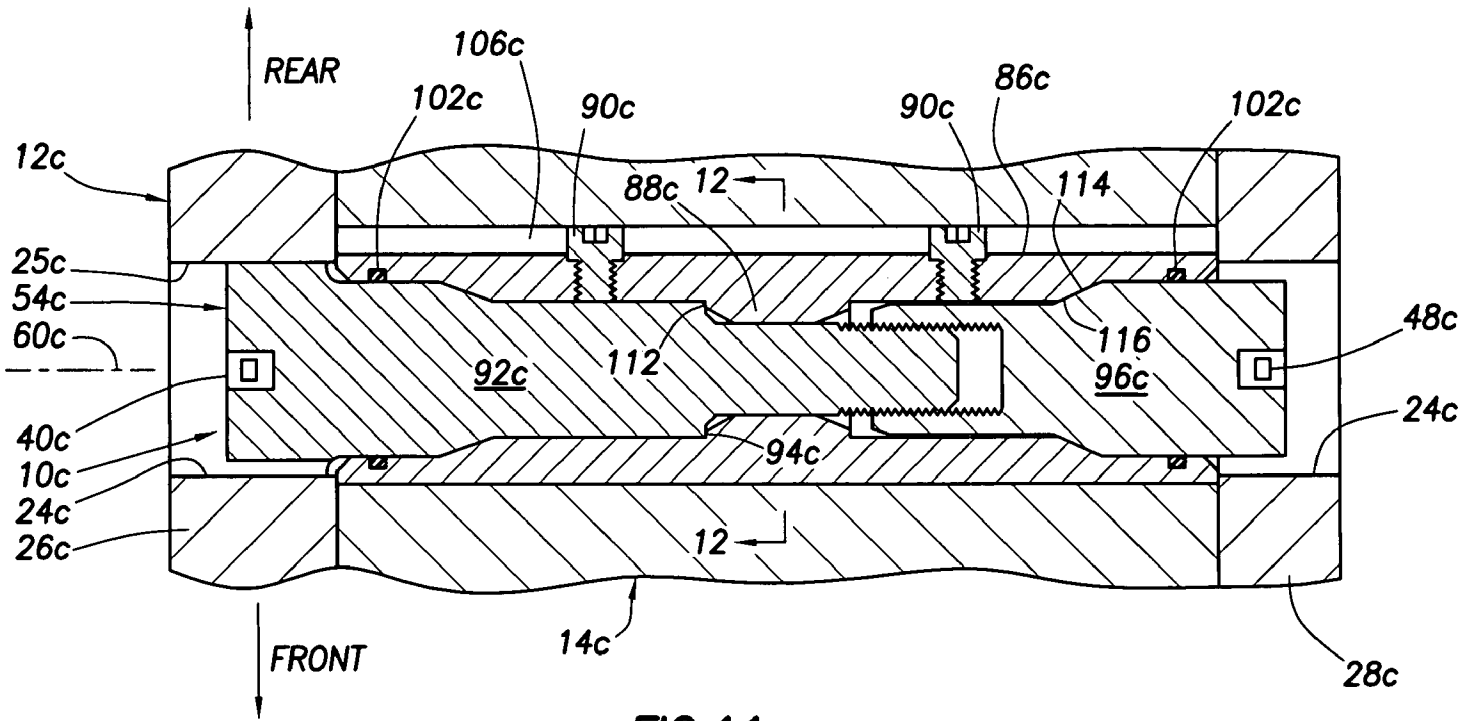
FIG. 11 is a cross-sectional view through portions of telescoped wear and support members being releasably interconnected by a third alternate embodiment of the cammed connector pin assembly.
Figure 12:
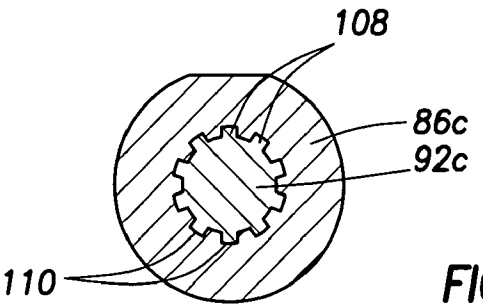
FIG. 12 is a cross-sectional view through the FIG. 11 cammed connector pin assembly taken along line 12-12 of FIG. 11.

A third alternate embodiment 10*c* of the previously described connector pin assembly 10 is illustrated in FIGS. 11 and 12 and is cross-sectionally shown in FIG. 11 captively retaining the wear member 12*c* on the nose portion 14*c* of a support member. Representatively, but not by way of limitation, the wear member 12*c* is an intermediate adapter and the support member is a base adapter. However, other types of wear and support members could be releasably interconnected by the connector pin assembly 10*c* without departing from principles of the present invention.

With the exceptions noted below, the connector pin assembly 10*c* is similar to the previously described connector pin assembly 10*b*. For purposes of facilitating a comparison of the connector pin assembly 10*c* with the connector pin assembly 10*b*, components in the assembly 10*c* similar or identical to those in the assembly 10*b* have been given identical reference numerals with the subscripts "c".

In the connector pin assembly 10*c* the rotational stop surfaces 103 on the previously described connector pin body portion 92 (FIG. 8) are eliminated, as are the lock washers 100. To prevent rotation of the pin body member 92*c* relative to the cartridge 86*c*, external splines 108 are added to an inner end portion of the pin body member 92*c* and are slidably received in corresponding grooves 110 formed on the inner side surface of the internal annular cartridge boss 88*c*. When the pin body portions 92*c*,96*c* are threadingly tightened to one another, the annular shoulder 94*c* on the pin body member 92*c* forcibly abuts a left annular side surface portion of the boss 88*c*. Additionally, a tapered annular surface 114 of the pin body member 96*c* forcibly abuts a corresponding tapered annular surface 116 within the cartridge 86*c* to inhibit rotational loosening of the pin body member 96*c* without the need for resiliently compressible structures within the cartridge 86*c*.

The cam member 54*c*, representatively shown in its rotationally adjusted wear member-tightening orientation, is similar in construction and operation to the previously described cam members 54, 54*a* and 54*b*. To effect this rotational adjustment of the cam member 54*c*, the connector pin body portion 96*c* is removed from the connector pin body portion 92*c*. The connector pin body portion 92*c* is then moved leftwardly to remove the splines 108 from their grooves 110, appropriately rotated to rotationally reposition the cam member 54*c*, and then moved rightwardly to re-insert the splines 108 in their grooves 110, thereby rotationally re-locking the connector pin body member 92*c* to the cartridge 86*c*. Finally, the connector pin body member 96*c* is re-tightened onto the connector pin body member 92*c*.

It can be seen that the cam 54*c*, like the previously described cams 54, 54*a* and 54*b*, serves as a wear member-tightening adjustment member, while the cartridge 86*c*, the threaded interconnection between the body members 92*c* and 96*c*, the splines 108 and associated grooves 110, and the interengagement of the lugs 90*c* and the nose opening groove 106*c*, function as representative locking structure for releasably locking the assembly 10*c* within the telescoped wear and support members with the tightening adjustment cam 54*c* in a selectively variable rotational orientation about the pin body axis 60*c* to permit the cam 54*c* to present a rearwardly adjustable abutment surface for a rear surface portion 25*c* of the wear member opening 24*c* in which the cam 54*c* is rotatably disposed.

The foregoing detailed description is to be clearly understood as being given by way of illustration and example only, the spirit and scope of the present invention being limited solely by the appended claims.

What is claimed is:

1. A connector pin assembly for use in captively retaining on a nose portion of an excavation support member an excavation wear member rearwardly telescoped onto the nose portion and having an opposing pair of walls respectively having first and second connector openings extending therethrough in general alignment with a connector opening extending through the nose portion, the wear member, in response to internal surface wear thereon, being rearwardly shiftable from an initially tightened position on the support member, said connector pin assembly comprising:

a connector pin structure longitudinally extending along an axis and being positionable in the wear member and support member connector openings in a manner such that first and second outer end portions of said connector pin structure respectively extend into the first and second wear member connector openings and block forward removal of the wear member from the support member, said first end portion of said connector pin structure having formed thereon a laterally outwardly projecting cam member with an eccentrically curved outer side surface which, with said first end portion of said connector pin structure disposed within said first wear member connector opening, is oriented to face the interior surface of said first wear member connector opening; and locking structure associated with said connector pin structure and cooperable with the support member, for selectively (1) permitting said first end portion, and thus said cam member, to be rotated relative to the wear member between first and second rotational orientations in which said outer side surface of said cam member extends different maximum distances rearwardly beyond said axis, and (2) locking said first end portion in either of said first and second rotational orientations, whereby said cam member may be rotationally adjusted to rearwardly engage the wear member in either of its initial and rearwardly shifted tightened positions and prevent its forward movement therefrom relative to the support member.

2. The connector pin assembly of claim 1 wherein:

said connector pin structure includes first and second longitudinal connector pin body portions coaxially and threadingly interconnected with one another and having axially facing surfaces that may be selectively moved toward and away from another in response to rotation of one of said first and second connector pin body portions relative to the other one of said first and second connector pin body portions.

3. The connector pin assembly of claim 2 wherein:

said locking structure includes a resilient structure interposed between and compressible by said axially facing surfaces of said first and second longitudinal connector pin body portions.

4. The connector pin assembly of claim 2 further comprising:

axially extending, non-circular recesses formed in outer end surfaces of said first and second longitudinal connector pin body portions.

5. The connector pin assembly of claim 1 wherein:

said connector pin structure includes first and second coaxial and threadingly interconnected longitudinal connector pin body portions having outer ends respectively defining said first and second outer end portions of said connector pin structure.

6. The connector pin assembly of claim 5 further comprising:

a tubular cartridge coaxially receiving said connector pin structure, and wherein said locking structure includes cooperating structures on said connector pin structure and said tubular cartridge, and releasably interlockable structures disposed on said tubular cartridge and said support member.

7. The connector pin assembly of claim 6 wherein:

said cooperating structures include cooperatively engageable tapered annular abutment surfaces on said cartridge and said connector pin structure.

8. The connector pin assembly of claim 6 wherein:

said cooperating structures include a resilient structure compressed between facing portions of said connector pin structure.

9. The connector pin assembly of claim 6 wherein:

said cooperating structures include splines disposed on one of said connector pin structure and said tubular cartridge and received in grooves disposed on the other of said connector pin structure and said tubular cartridge.

10. A connector pin assembly insertable into generally aligned connector openings in an excavating support member and an excavating wear member rearwardly telescoped onto a portion of the support member, the wear member, in response to internal surface wear thereon, being rearwardly shiftable on the support member from an initial tightened position thereon, said connector pin assembly comprising:

a connector pin structure positionable in the generally aligned connector openings in a manner such that an end portion of said connector pin structure blocks removal of the wear member from the support member;

a wear member tightening structure carried on said connector pin structure and being movable between first and second positions to respectively engage the wear member in its initial and rearwardly shifted positions in a manner blocking forward movement of the wear member relative to the support member; and locking structure for releasably locking said wear member tightening structure in each of said first and second positions thereof, said connector pin assembly further comprising a tubular cartridge coaxially receiving a longitudinally intermediate portion of said connector pin structure in a manner such that opposite end portions of said connector pin structure extend axially outwardly of opposite ends of said tubular cartridge, and said locking structure including cooperating structures on said connector pin structure and said tubular cartridge for selectively preventing relative rotation between said connector pin structure and said tubular cartridge, and a stop structure on said tubular cartridge for cooperating with a portion of the support member to prevent rotation of the tubular cartridge relative to the support member.

11. The connector pin assembly of claim 10 wherein:

said cooperating structures on said connector pin structure and said tubular cartridge include spline members formed on one of said connector pin structure and said tubular cartridge and grooves formed on the other one of said connector pin structure and said tubular cartridge and operatively receiving said spline members.

12. The connector pin assembly of claim 10 wherein:

said cooperating structures on said connector pin structure and said tubular cartridge include resiliently deformable structures axially interposed between facing surface portions of said connector pin structure and said tubular cartridge.

13. The connector pin assembly of claim 10 wherein:

said stop structure includes at least one lateral projection formed on an outer side surface of said tubular cartridge.

14. The connector pin assembly of claim 10 wherein:

said cooperating structures on said connector pin structure and said tubular cartridge include complementarily engageable tapered annular abutment surfaces formed on said tubular cartridge and said connector pin structure.

15. Excavating apparatus comprising:

a support member having a forwardly projecting nose portion with a connector opening extending therethrough;

a hollow replaceable wear member rearwardly telescoped onto said support member and having opposite exterior side walls with first and second connector openings extending therethrough in general alignment with said connector opening of said nose portion, said wear member, in response to interior surface wear therein, being rearwardly shiftable on said nose portion from an initial tightened position thereon to a rearwardly shifted tightened position thereon; and a connector pin assembly captively and releasably retaining said wear member on said nose portion of said support member, said connector pin assembly including:

a connector pin structure longitudinally extending along an axis and being positionable in the wear member and support member connector openings in a manner such that first and second outer end portions of said connector pin structure respectively extend into the first and second wear member connector openings and block forward removal of the wear member from the support member, said first end portion of said connector pin structure having formed thereon a laterally outwardly projecting cam member with an eccentrically curved outer side surface which, with said first end portion of said connector pin structure disposed within said first wear member connector opening, is oriented to face the interior surface of said first wear member connector opening, and locking structure associated with said connector pin structure and cooperable with the support member, for selectively (1) permitting said first end portion, and thus said cam member, to be rotated relative to the wear member between first and second rotational orientations in which said outer side surface of said cam member extends different maximum distances rearwardly beyond said axis, and (2) locking said first end portion in either of said first and second rotational orientations, whereby said cam member may be rotationally adjusted to rearwardly engage the wear member in either of its initial and rearwardly shifted tightened positions and prevent its forward movement therefrom relative to the support member.

16. The excavating apparatus of claim 15 wherein:

said wear member is a replaceable tooth point, and said support member is an adapter.

17. The excavating apparatus of claim 15 wherein:

said wear member is an intermediate adapter, and said support member is a base adapter.

18. The excavating apparatus of claim 15 wherein:

said connector pin structure includes threadingly interconnected first and second longitudinal connector pin body portions.

* * * * *